United States Patent [19]

McGannon

[11] Patent Number: 5,023,601

[45] Date of Patent: Jun. 11, 1991

[54] SMOKE DETECTOR FOR TV

[76] Inventor: Patrick J. McGannon, 2797 Stevens St., Oceanside, N.Y. 11572

[21] Appl. No.: 316,079

[22] Filed: Feb. 27, 1989

[51] Int. Cl.[5] ..... G08B 17/10

[52] U.S. Cl. ..... 340/628; 340/521; 340/693; 340/310 CP; 340/630

[58] Field of Search ..... 340/628, 310 CP, 693, 340/521, 629, 630; 356/439

[56] References Cited

U.S. PATENT DOCUMENTS

| | | | |
|---|---|---|---|
| 4,149,154 | 4/1979 | Whetstone | 340/521 |
| 4,178,592 | 12/1979 | McKee | 340/693 |
| 4,471,346 | 9/1984 | Nelson et al. | 340/628 |
| 4,525,703 | 6/1985 | Bellino | 340/628 |
| 4,785,288 | 11/1988 | Heberlein, Jr. | 340/628 |

*Primary Examiner*—Joseph A. Orsino
*Assistant Examiner*—Kinfe-Michael Negash
*Attorney, Agent, or Firm*—James P. Malone

[57] ABSTRACT

In a conventional TV, audio or other equipment having a speaker(s) and a source of power. A smoke detector is mounted inside the TV case, the output of the smoke detector being connected to the TV speaker and a power supply connected to the TV source of power, the output of said power supply being connected to the smoke detector, the smoke detector and power supply being packaged together and installed inside the case of the TV. A second oscillator may be added to thereby emit at least four frequencies because of the hetrodyning of the two oscillators.

2 Claims, 1 Drawing Sheet

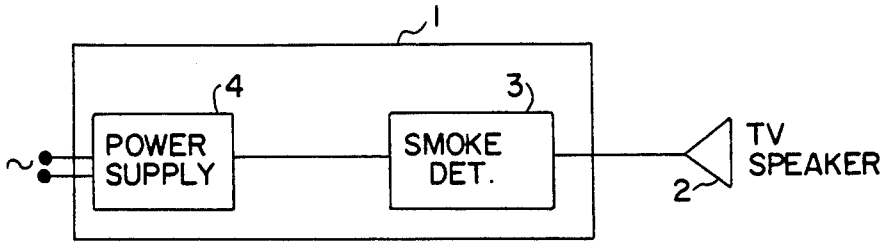
FIG. 2
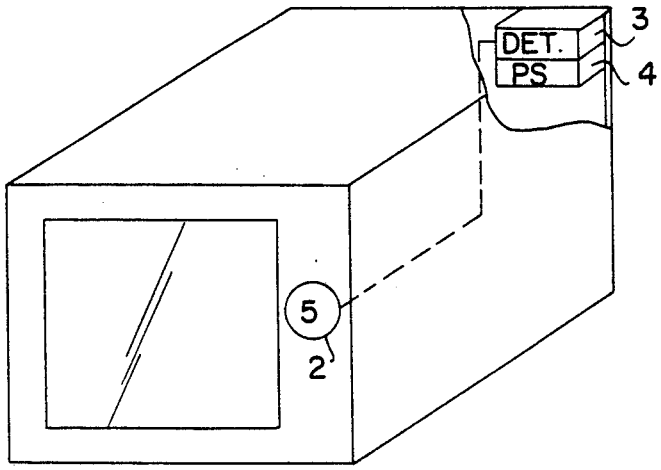
FIG. 1
FIG. 7
FIG. 3
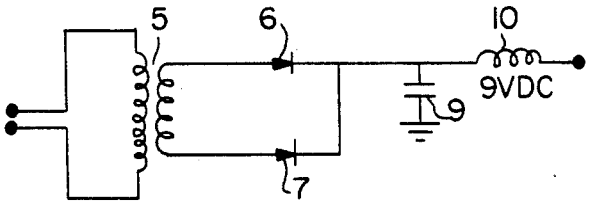
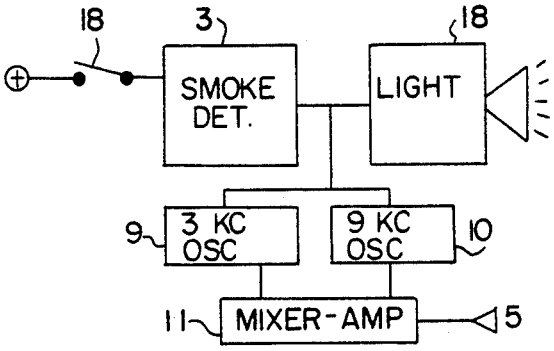
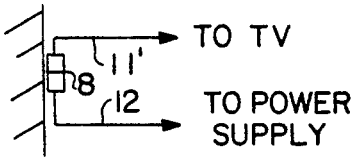
FIG. 5
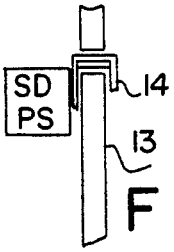
FIG. 4
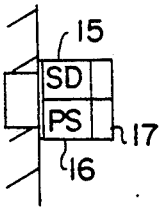
FIG. 6

SMOKE DETECTOR FOR TV

This invention relates to smoke detectors and, more particularly, to a miniature smoke detector adapted to be installed in a TV set.

BACKGROUND

Many fires are started in TV sets and smoke detectors are not provided as part of any manufactured TV set.

PRIOR ART

Various smoke detector devices are shown in the following patents:

U.S. Pat. Nos. 3,289,194, 4,149,154, 4,177,461, 4,365,237, 4,471,346.

However, none of them show the applicant's compact smoke detector adapted to be installed in a TV set and do not make it obvious to those skilled in the art.

THE INVENTION

The two most expensive items in conventional smoke detectors are the power supply, which is a battery, and a speaker. Batteries wear out even if not in use and must be periodically tested and are not reliable because people do not test them periodically.

The present invention eliminates the need for batteries and a speaker. The present invention is adapted to be installed in a conventional TV or audio equipment of the type having a speaker and a source of power. A conventional smoke detector is connected to a miniature power supply that can be mounted on a printed circuit card and connected to a power socket built into the end of a compartment in the top of a rear corner of a TV set; either corner is satisfactory. The power supply and smoke detector may be packaged together in a relatively small box; for instance, the size of a pack of cigarettes.

Some persons have hearing deficiencies at certain frequencies, i.e. may not hear 5 KC to 6 KC. The present system will emit four frequencies—3, 6, 9 and 12 KC.

Since the power supply can be considered unlimited, I put two (2) audio oscillators on the card and each oscillator would best with the other output and the heterodyne of all frequencies would be the two oscillators' frequencies, both added together, and also the lower frequency subtracted from the higher frequency (plus and minus)—example A 3000 hertz frequency beating against a 9000 hertz frequency and your output when they beat against each other would be 3000 hertz 6000 hertz, 9000 hertz and 12,000 hertz, namely, the addition and subtraction of the two fundamentals, plus the fundamentals by themselves. Four frequencies would be the output to the speaker(s). Anyone that cannot hear one frequency has the opportunity to hear at least one out of four, unless that person is stone deaf. Once again, the power is available from the TV-A/C line to the audio equipment. I believe a 9 volt battery would run down because of its limited age capacity.

OBJECTS OF THE INVENTION

Accordingly, a principal object of the invention is to provide a new and improved smoke detector which is novel, inexpensive and ideally situated for safety's sake.

Another object is to provide a new and improved smoke detector which eliminates the batteries and alarm speaker requirements and does not have to be checked periodically, but can be so made.

Another object of the invention is to provide a new and improved smoke detector for TV viewing apparatus.

These and other objects of the invention comprise means to emit different frequency warnings for partially deaf people and will be apparent from the following specifications and drawings:

BRIEF DESCRIPTION OF DRAWINGS

FIG. 1 is a perspective view of a TV set with the smoke detector embodiment installed.

FIG. 2 is a schematic block diagram of an embodiment of the invention.

FIG. 3 is a schematic circuit diagram of a conventional power supply.

FIG. 4 is a detailed view showing how the detector power supply box may be attached to the TV case, having slotted side in back and top to allow circulation of air.

FIG. 5 is a diagram illustrating direct connection of the power supply of the present invention to a wall socket.

FIG. 6 shows a side view of another embodiment of the invention.

FIG. 7 is a schematic diagram of a heterodynamic system that emits at least four frequencies.

Referring to the drawings, FIG. 1 shows a perspective view of a TV set 1 of the type having a speaker 2 and means to connect the TV to a source of power. The smoke detector 3 and power supply 4 are packaged together and installed in a rear top corner of the case of the TV set 1. The output of the detector 3 is connected to the existing speaker 2 of the TV set 1 for alarm purposes.

FIG. 2 shows a block diagram illustrating the power supply 4 for smoke detector 3 and the existing TV speaker 2. The smoke detector 3 may be any of a number of conventional smoke detectors which generally use batteries and required an input of 9 V DC, which is supplied by the power supply 4, all mounted on a card 18.

FIG. 3 shows a schematic diagram of a conventional power supply which may be used. It comprises a transformer 5 and a pair of rectifiers 6 and 7, a filter consisting of a condenser 9 and a coil 10.

FIG. 4 shows a method of mounting the smoke detector power supply package inside a wall 13 of the TV 1. The smoke detector power supply is package in a small box and is mounted on a hook member 14, which is passed through a slot in the wall 13. These slots are conventional providing ventilation. Adhesive may be used.

FIG. 5 shows an alternate method of providing power for the smoke detector which eliminates any installation of the power supply in the TV set. In this embodiment, a double socket 8 is plugged into the wall socket. The TV power is plugged into one side through plug 11 and the smoke detector is plugged in through plug 12.

When the power supply of the present invention is connected to an existing TV inside the TV set, then it is connected before the TV switch so that continuous power is supplied to the smoke detector.

A typical circuit could use a printed circuit card having a power supply and smoke detector mounted on the card. This type of installation can make the smoke detector optional equipment provided by the manufacturer.

The present invention may be used in other places than TV sets; for instance, it may be mounted directly on a wall socket or at any distance from the wall socket by the use of an extension cord.

FIG. 6 shows the present invention comprising a smoke detector 15 and a power supply 16. In this case, however, an alarm speaker 17 must be connected to the output of the smoke detector. This is a very convenient package and eliminates the need for dependence on batteries which require periodic testing, which is not always done.

In some TV sets there may be 9 V DC available already, but this would have to be continuous, whether or not the TV was on or off.

The power supply can be mounted on the printed circuit card or the TV, or it can have the female socket installed at the factory. The card can be optional if the customer desires it.

The package may have a line cord so the detector unit can be hung onto a hook or laid next to the equipment that may catch fire, such as electric motors.

FIG. 7 shows a smoke detector 3 which is connected to an oscillator 9, which emits a 3,000 hertz tone and to an oscillator 10, which emits a 9,000 hertz tone. The output of the oscillators are connected to the mixer-amplifier 11, the output of which is connected to the speaker S. A flashing light 18 may be connected to the smoke detector if desired for visual warning.

What is claimed is:

1. In a conventional T.V. having a speaker and a source of power, a smoke detector, a first frequency oscillator, the output of the smoke detector being connected to said oscillator, a power supply connected to the T.V. source of power, the output of said power supply being connected to said smoke detector, the smoke detector and power supply being packaged together and installed inside the case of the T.V., a second oscillator, having a second frequency and means connected to the oscillators to heterodyne the first and second frequencies to emit a plurality of frequencies, wherein the output of said means to heterodyne the first and second frequencies is connected to said speaker.

2. Apparatus as in claim 1, having multiple oscillators having different frequencies, connected to the smoke detector and means to heterodyne the different frequencies to emit a plurality of audio frequencies.

* * * * *